United States Patent [19]

Bunczk et al.

[11] Patent Number: 4,911,858

[45] Date of Patent: Mar. 27, 1990

[54] TOILET BOWL CLEANER

[75] Inventors: Charles J. Bunczk, Norristown; Peter A. Burke, Downington; William R. Camp, Pennside, all of Pa.

[73] Assignee: Kiwi Brands, Inc., Douglasville, Pa.

[21] Appl. No.: 244,736

[22] Filed: Sep. 15, 1988

[51] Int. Cl.[4] ..... C11D 3/04; C11D 3/20; C11D 3/22; C11D 17/00

[52] U.S. Cl. ..... 252/106; 252/89.1; 252/174; 252/174.17; 252/174.21; 252/174.22; 252/DIG. 16; 134/42; 4/227; 4/228

[58] Field of Search ..... 252/90, 89.1, 106, 134, 252/174, 174.21, 174.17, 174.22, 170, DIG. 16; 134/42

[56] References Cited

U.S. PATENT DOCUMENTS

| | | | |
|---|---|---|---|
| 4,043,931 | 8/1977 | Jeffrey et al. | 252/93 |
| 4,278,571 | 7/1981 | Choy | 252/558 |
| 4,308,625 | 1/1982 | Kitko | 4/228 |
| 4,310,434 | 1/1982 | Choy et al. | 252/174.21 |
| 4,396,522 | 8/1983 | Callicott et al. | 252/174.21 |
| 4,460,490 | 7/1984 | Barford et al. | 252/92 |
| 4,477,363 | 10/1984 | Wong et al. | 252/134 |
| 4,722,801 | 2/1988 | Bunczk et al. | 252/106 |

*Primary Examiner*—Paul Lieberman
*Assistant Examiner*—John F. McNally
*Attorney, Agent, or Firm*—Steele, Gould & Fried

[57] ABSTRACT

Solid cake lavoratory cleansing block compositions comprising polyethylene glycol polymer and guar gum, and optional ingredients which include fragrances, dyes, solid binders, filler material and mixtures thereof.

14 Claims, No Drawings

TOILET BOWL CLEANER

FIELD OF THE INVENTION

The present invention relates to cake compositions which are useful for the treatment of the flush water of toilets. More particularly, the invention is concerned with a long lasting toilet tank dispenser which results from the synergistic combination of guar gum and polyethylene oxide homopolymers.

BACKGROUND OF THE INVENTION

In treating toilet flush water with chemicals in order to produce desirable effects such as bowl aesthetics, cleaning, disinfection, deodorization, aerosol reduction, etc., it is desirable that the chemicals be dispensed into the flush water automatically each time the toilet is flushed. The prior art discloses numerous devices which have been designed for this purpose.

Particularly desirable devices are those comprising a solid cake composition. In this type of device a measured amount of water enters the device during one flush cycle and remains in contact with the cake between flushes, thereby forming a concentrated solution of the composition which is dispensed into the flush water during the next flush. The advantages of such devices are hat the chemical composition can be packaged and shipped in more concentrated form than aqueous solutions of the chemicals. Also, the problems of liquid spillage resulting from breakage of the dispensers during shipment or handling is eliminated.

Prior art surfactant cake compositions are disclosed in U.S. Pat. No. 4,308,625, Kitko, issued Jan. 5, 1982 and U.S. Pat. No. 4,043,931, Jeffrey et al, issued Aug. 23, 1977. These patents disclose a lavoratory cleansing tablet which is formed with two or more nonionic surfactants which includes the use of polyalkoxylated alcohols. U.S. Pat. No. 4,477,363, Wong et al, issued Oct. 16, 1984, discloses a solid cake comprising free fatty alcohol and a buffered alkali earth metal alky sulfate surfactant. U.S. Pat. No. 4,310,434, Choy et al, issued Jan. 12, 1982; and U.S. Pat. No. 4,278,571, Choy, issued July 14, 1981, entitled "Surfactant Cake Compositions", all of which are incorporated herein by reference, disclose surfactant cake compositions containing dyes and perfumes which may be utilized in the present invention. The surfactants provide cleaning and sudsing in the toilet bowl and also serve to dispense other components of the compositions such as dyes, perfumes, organic resins, etc.

U.S. Pat. No. 4,460,490 discloses the use of natural gums in combination with fatty alcohol ethoxylates. However, guar gum and polyethylene oxide homopolymers which produced the synergism in the present invention are not disclosed.

The polyethylene oxide hompolymers which are utilized in the present invention are commercially available and sold by Union Carbide Corp. under the trademark POLYOX. The POLYOX resins are high polymers with the common structure: $-(O-CH_2CH_2)-_n$. The degree of polymerization, n, varies from about 2,000 to about 100,000, depending upon the viscosity grade of resin.

POLYOX resins are non-ionic and undergo the normal salting-out effects associated with neutral molecules in solutions of high dielectric media. Salting-out effects manifests themselves in depressing the upper temperature limit of solubility and in reducing the viscosity of both dilute and concentrated solutions of the polymers.

Water-soluble inert salts such as alkali metal chlorides and sulfates are normally used in such compositions to act as a "filler" so that the composition can be formed into cakes of desirable size without using excessive amounts of active ingredients. The predominant ingredients of the cake compositions are usually the surfactant, perfume and the filler salt.

In U.S. Pat. No. 4,722,801 of Bunczk et al, which is herein incorporated by reference, there is disclosed the synergism which occurs in the combination of guar gum and sodium chloride.

A major problem in prior art has been short and/or erratic longevity of surfactant cakes because of rapid and/or uneven dissolution resulting in decreased cake stability and longevity.

It has been found that a solid cake composition having a long and uniform block life can be provided where the composition includes the combination of guar gum and polyethylene oxide homopolymer together with the conventional materials such as surfactants, fillers, binders, dyes, fragrances, extenders and the like.

It has been further found that cross-linking of guar gum with a calcium ion further extends the life of the composition.

It is an object of the present invention to provide a solid cake compositions which includes the combination of guar gum and polyethylene oxide homopolymers, which compositions are suitable for use for automatically dispensing cleaning agents into the toilet.

It is a further object of the present invention to increase the cake life by the cross-linking of the guar gum with a calcium salt.

It is a still further object of the present invention to provide a lavoratory block which has a long and uniform block life.

Other objects, advantages and novel features of the present invention will be apparent to those skilled in the art from the following description and appended claims.

SUMMARY OF THE INVENTION

The objectives of the invention are achieved by providing a solid unsupported cake composition which comprises a polyethylene oxide polymer having a molecular weight between about 1 to 6 million, preferably about 4 to 6 million in an amount of at leas about 1% by weight of composition, preferably about 1.5 to 6%, guar gum in an amount of about 1 to 25% by weight of composition, preferably 6 to 20%, and optional ingredients selected from the groups consisting of surfactants, fragrances, dyes, binders, filler material and mixtures thereof. Advantageously, the cake composition includes at least about 1.0% by weight of a calcium salt so as to cross-link the guar gum.

The polyethylene oxide polymer/guar gum combination is believed to provide a selective membrane after hydration and gelation so that the components ar entrapped within this matrix and coordinates their release without the expected loss of salts utilized in the formulation.

DESCRIPTION OF THE PREFERRED EMBODIMENTS

According to one embodiment of the invention a toilet cake composition is provided in tablet form which comprise at least about 1% by weight of composition of a polyethylene oxide homopolymer having a molecular weight between about 1 to 6 million, about 1 to 25% by weight of composition of guar gum, at least 1.0% by weight of a calcium salt, and the remainder of the ingredients comprising optional ingredients selected from the group consisting of surfactants, fragrances, dyes, fillers including inert salts, binders, extenders and the like.

A suitable composition for forming a tablet by the compression method comprises about 0–70% by weight calcium sulfate, about 5–80% by weight sodium chloride, about 1–5% by weight polyethylene oxide polymer, about 5–20% by weight guar gum, 0–3% by weight compaction acid stearic acid), about 2–8% by weight binder, about 2–10% by weight fillers including optionally, plasticizers, dyes, fragrances, perfumes, and bacteriostatic agents.

Suitable binders which may be utilized include ethylene oxide/propylene oxide copolymer and PEG 8000 (a high molecular weight polyethylene glycol).

For the tablets which are to be prepared by extrusion, about 10–25% by weight of extrusion aids may be added anionic alkalyds, for example sodium dodecylbenzene sulfonate.

As a further binding agent, the use of solid emollients have been found to be helpful to prevent the cake of the invention from mounding out. Suitable emollients include glyceryl monostearate, glyceryl monopalmitate, ethylene glycol stearate, propylene glycol monostearate, and the like, most preferably is glyceryl monostearate which provides a matrix to prevent mounding. The emollients may be utilized in amounts of about 0 to about 10% by weight, preferably about 5% to about 10%.

In some cases it has been found to be advantageous to utilize certain nonionic surfactants in the cake formulation. Nonionic surfactants that may be included are the condensation products of a long chain ethylene oxide moiety with an aliphatic alcohol preferably a primary or secondary aliphatic alcohol or alkyl phenol, preferably the primary or secondary alcohol contains 8 to 20 carbon atoms and the alkyl phenol-based moiety is one wherein the alkyl chain is straight or branched and contains 6 to 12 carbon atoms, preferably 8 to 9 carbon atoms.

Illustrative nonionic surfactants having the desired characteristics for formulation are available on the market under the tradename of "Neodol" products by Shell Oil Company; "Tergitol" products by Union Carbide Company; and "Alfol" products by Continental Oil Company. Specific examples include "Neodol 25-7" (linear $C_{12}$–$C_{15}$ primary alcohol condensed with 7 moles of ethylene oxide per mole of alcohol); "Neodol 45-7" (linear $C_{14}$–$C_{15}$ primary alcohol mixture condensed with 7 moles of ethylene oxide per mole of alcohol); "Tergitol 15-S-7" (random secondary $C_{11}$–$C_{15}$ alcohol condensed with 7 moles of ethylene oxide per mole of alcohol); and "Alfol 1416-6.5" (primary $C_{14}$–$C_{16}$ alcohol condensed with 6.5 moles of ethylene oxide per mole of alcohol).

Such nonionic surfactants act as coupling agents to provide an integration of the cake components and may be used in the amount of about 0 to 10% by weight of the cake formulation.

The water-soluble inert salts used in the present compositions as "fillers" so that the composition can be formed into cakes of desired size without using excessive amounts of active ingredients. They are used alone or in combination in amounts up to about 80% by weight.

The inert salts (filler salts) used in the compositions of the present invention can be any water-soluble inorganic or organic salt or mixtures of such salts. For purposes of the present invention, "water-soluble" means having a solubility in water of at least 1.0 grams per hundred grams of water at 20° C. Examples of suitable salts include various alkali metal and/or alkaline earth metal sulfates, chlorides, borates, bromide, citrates, acetates, lactates, etc.

Specific examples of suitable salts include calcium sulfate, sodium chloride, potassium sulfate, sodium carbonate, lithium chloride, tripotassium phosphate, sodium borate, potassium bromide, potassium fluoride, sodium bicarbonate, calcium chloride, magnesium chloride, sodium citrate, sodium acetate, calcium lactate, magnesium sulfate and sodium fluoride. The preferred salts are the inorganic salts, especially the alkali metal sulfates and chlorides. Particularly preferred salts, because of their low cost, are calcium sulfate and sodium chloride. The salts are present in the compositions herein at levels of from up to about 80% by weight. Most preferably, sodium chloride is utilized together with guar gum either alone or together with calcium salts.

Calcium sulfate is advantageously utilized alone or together with the guar gum or together with sodium chloride because it has a low solubility level which is constant over the water temperature range likely to exist within toilet tanks as well as providing synergistic effects.

Various optional materials may be included in the compositions herein.

Dyes may be included at levels of from up to 15.0% by weight. Examples of suitable dyes are Alizarine Light Blue B (C.I. 63010), Acid Yellow 23, Acid Violet 17, Direct Violet 51, Carta Blue VP (C.I. 24401), Acid Green 2G (C.I. 42085), Astragon Green D (C.I. 42040), Supranol Cyanine 7B (C.I. 42675), Maxilon Blue 3RL (C.I. Basic Blue 80), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9 (AB#9). Others are disclosed in the aforementioned U.S. Pat. Nos. 4,110,434 and 4,477,363, which are herewith incorporated by reference.

If desired, the cakes of the invention may also contain up to about 15% by weight of a cationic quaternary ammonium salt.

It is known that the cationic quaternary ammonium salts which include a greater number of short-chain alkyl groups in the structure, incline toward better bacteriostatic properties. Specific examples of bacteriostatic agents that may be used in the compositions of this invention include di-isobutyl cresoxy ethoxy ethyl dimethyl benzyl ammonium chloride, di-isobutyl phenoxy ethoxy ethyl dimethyl benzyl ammonium chloride, myristyl dimethylbenzene ammonium chloride, benzalkonium chloride, cetyl pyridnium chloride, coconut dimethyl benzyl ammonium chloride, stearyl dimethyl benzyl ammonium chloride, alkyl dimethyl benzyl ammonium chloride, alkyl diethyl benzyl ammonium chloride, alkyl dimethyl benzyl ammonium bromide, di-isobutyl phenoxy ethoxy ethyl trimethyl ammonium chloride, di-isobutyl phenoxy ethoxy ethyl dimethyl alkyl ammonium chloride, methyl-dodecylbenzyl trimethyl ammonium chloride, cetyl trimethyl ammonium bromide(CTAB), octadecyl dimethyl ethyl ammonium bromide, cetyl dimethyl ethyl ammonium bromide, octadecenyl-9-dimethyl ethyl ammonium bromide, dioctyl dimethyl ammonium chloride, dodecyl trimethyl ammonium chloride, octadecyl trimethyl ammonium chloride, octadecyl trimethyl ammonium bromide, hexadecynyl trimethyl ammonium iodide, octyltrimethyl ammonium fluoride, and mixtures thereof. Other water dispersible salts, such as the acetates, sulfates, nitrates, and phosphates, are effective in place of the halides, but the chlorides and bromides are preferred.

The cakes may also contain perfumes to impart an acceptable odor to the flushing water. The perfume may be in solid form and is suitably present in an amount up to 15% by weight. In this connection, it may be noted that the term "perfume" is intended to refer to any material giving an acceptable odor and thus materials giving a "disinfectant" odor such as essential oils, pine extracts, terpinolenes, ortho phenyl phenol or paradichlorobenzene may be employed. The essential oils and pine extracts also contribute as plasticizers and are functional to a degree in extending block life.

Certain perfume materials may be added which additionally function to control the solubility of anionic sulfate or sulfonate surfactants. Examples of such perfume materials are isobornyl acetate, myristenyl acetate and frenchyl acetate. Other suitable perfumes or fragrances are disclosed in U.S. Pat. No. 4,396,522 of Callicott et al, which is herein incorporated by reference.

The cake formulation may also contain other binding and/or plasticizing ingredients serving to assist in the manufacture thereof, for example, polypropylene glycol having a molecular weight from about 300 to about 10,000. Other suitable plasticizers such as pine oil fractions, d-limonene, dipentene and the ethylene oxide-propylene oxide block copolymers may be utilized.

The blocks of the present invention can be produced by a variety of conventional process, e.g., casting-/moulding process, by tablet compression process or by an extrusion process. The tablet process is he preferred process of the invention.

The shaped tablets or blocks each suitably having a weight of from 20 to 150 grams, preferably from 30 to 70 grams.

In order that the invention may be better understood the following examples are given by way of illustration only. In the specification and examples, all parts and percentages are by weight throughout the specification unless otherwise stated.

The following examples are for compositions suited for forming shaped bodies of blocks.

EXAMPLE I

The following compositions were utilized in preparing tablets by conventional compaction methods.

| | A Roller Compaction | B Direct Compression |
|---|---|---|
| $CaSO_4$ | 58.7 | 58.7 |
| NaCl (YPS solar feed) | 5.0 | 5.0 |
| IBA | 0.5 | 0.5 |
| T-Det N-8 | 0.5 | 0.5 |
| AB #9 dye | 5.0 | 5.0 |
| CTAB | 0.5 | 0.5 |
| Polyox | 1.8 | 1.8 |
| Guar Gum | 18.0 | 18.0 |
| EO/PO F68 | 10.0 | 10.0 |
| | 100.0% | 100.0% |

EXAMPLE II

The following compositions were utilized in preparing tablets by the direct compression method.

| | A | B | C |
|---|---|---|---|
| $CaSO_4$ | — | 49.2 | 51.2 |
| NaCl[4] | 76.2 | 25.0 | 25.0 |
| Polyox | 1.8 | 1.8 | 1.8 |
| Fragrance | 3.0 | 3.0 | 3.0 |
| CTAB | 0.5 | 0.5 | 0.5 |
| AB #9 dye | 5.5 | 5.5 | 5.5 |
| Guar Gum | 8.0 | 10.0 | 8.0 |
| Oxalic Acid | 1.0 | 1.0 | 1.0 |
| Citric Acid | 4.0 | 4.0 | 4.0 |
| | 100.0% | 100.0% | 100.0% |

EXAMPLE III

The following compositions were utilized in preparing tablets by the direct compression method.

| | |
|---|---|
| $CaSO_4$ | 61.35 |
| NaCl | 24.35 |
| IBA | 0.50 |
| T-Det N-8 | 0.50 |
| CTAB | 0.50 |
| Polyox | 1.80 |
| Guar Gum | 6.00 |
| AB #9 dye | 5.00 |
| | 100.00% |

EXAMPLE IV

The following compositions were utilized in preparing tablets by the roller compaction method

| | A | B |
|---|---|---|
| $CaSO_4$ | 55.5 | 61.35 |
| NaCl | 20.0 | 20.35 |
| IBA | 1.5 | 0.50 |
| T-Det N-8 | 1.5 | 0.50 |
| CTAB | 0.5 | 0.50 |
| Polyox | 2.0 | 1.80 |
| Guar Gum | 10.0 | 10.00 |
| AB #9 dye | 5.0 | 5.00 |
| PVP K-90 | 2.0 | — |
| Stearic Acid | 2.0 | — |
| | 100.0% | 100.00% |

If desired 4% by weight of anionic or nonionic surfactant can be added in lieu of a portion of $CaSO_4$.

EXAMPLE V

The following experiments were performed in order to demonstrate the criticality of the concentration level of the Polyox coagulant on block life.

| | A % wt. | B | C | D | E |
|---|---|---|---|---|---|
| Soft-N-Soil | 53.0 | 52.5 | 51.5 | 49.5 | 47.5 |
| NaCl | 20.0 | 20.0 | 20.0 | 20.0 | 20.0 |
| T-Det N-8 | 0.5 | 0.5 | 0.5 | 0.5 | 0.5 |
| Isobornyl Acetate - Fragrance | 0.5 | 0.5 | 0.5 | 0.5 | 0.5 |
| Acid Blue #9 | 5.0 | 5.0 | 5.0 | 5.0 | 5.0 |
| Polyox Coagulant | 0.5 | 1.0 | 2.0 | 4.0 | 6.0 |
| CTAB | 0.5 | 0.5 | 0.5 | 0.5 | 0.5 |
| Guar Gum HV400 | 10.0 | 10.0 | 10.0 | 10.0 | 10.0 |
| Pluronic F-68 | 10.0 | 10.0 | 10.0 | 10.0 | 10.0 |

-continued

| | A | B | C | D | E |
|---|---|---|---|---|---|
| Block Life | 30 days | 33 days | 42 days | 55 days | 61 days |

The principals, preferred embodiments and modes of operation of the present invention have been described in the foregoing specification. The invention which is intended to be protected herein, however, is not to be construed as limited to particular forms disclosed, since these are to be regarded as illustrative rather than restrictive. Variations and changes may be made by those skilled in the art without departing from the spirit of the invention.

What is claimed is:

1. A solid cake lavoratory cleansing block composition comprising from at least about 1% by weight of composition of polyethylene oxide polymer having a molecular weight from about 1 million to about 6 million, about 1% to 25% by weight of composition of guar gum, about 5 to 80% of inert salts which include at least sodium chloride, and the remainder being ingredients selected from the group consisting of surfactants, fragrances, dyes, binders, filler material and mixtures thereof, said polyethylene oxide polymer and guar gum being present in a combination whereby after hydration and gelation a matrix is formed which entraps the components and coordinates their release.

2. The cleansing block composition of claim 1 including at least 1.0% by weight of a calcium salt.

3. The cleansing block composition of claim 1 including sodium chloride in an amount sufficient for providing a viscosity increase in water and relative insolubility of the total block.

4. The cleansing block composition of claim 1 wherein said filler material comprises calcium sulfate.

5. The cleansing block composition of claim 1 wherein said filler material comprises calcium sulfate and sodium chloride.

6. The cleansing block composition of claim 1 including a cationic quaternary ammonium salt.

7. The cleansing block composition of claim 1 including a plasticizer selected from the group consisting of polypropylene glycol, dipentene, pine oil fractions, d-limonene and ethylene oxide-propylene oxide copolymers.

8. A lavoratory cleansing block composition comprising:

(a) from about 1% to about % by weight of composition of polyethylene oxide homopolymer having a molecular weight from about 1 million to about 6 million, (b) about 5 to about 20% by weight of composition of guar gum;

(c) about 5 to about 80% by weigh of composition of sodium chloride;

(d) 0 to about 70% by weight of composition of calcium sulfate; and (e) up to about 15% by weight of composition of disinfecting agents, coloring and/or fragrances, said polyethylene oxide polymer and guar gum being present in a combination whereby after hydration and gelation a matrix is formed which entraps the components and coordinates their release.

9. The composition of claim 8 which includes at least 1% by weight of composition of a calcium salt.

10. The block of claim 8 which is formed by compression.

11. The composition of claim 8 including 10–25% by weight of composition of an extrusion aid.

12. The composition of claim 8 including a plasticizer selected from the group consisting of polypropylene glycol, dipentene, pine oil fractions, d-limonene and ethylene oxide-propylene oxide copolymers.

13. In a solid cake lavoratory cleansing block composition comprising guar gum as a dissolution control agent, the improvement which comprises including about I% to about 6% by weight of composition of polyethylene oxide polymer having a molecular weight from about 1 million to about 6 million and at least about 1% by weight of a crosslinking agent for the guar gum consisting of a calcium salt.

14. The composition of claim 13 wherein the molecular weight of said polyethylene oxide polymer is about 4 to 6 million.

* * * * *

UNITED STATES PATENT AND TRADEMARK OFFICE

CERTIFICATE OF CORRECTION

PATENT NO. : 4,911,858

DATED : March 27, 1990

INVENTOR(S) : Bunczk et al.

It is certified that error appears in the above-identified patent and that said Letters Patent is hereby corrected as shown below:

Column 1, line 28, delete "hat" and insert --that--.

Column 2, line 47, delete "leas" and insert --least--.

Column 2, line 58, delete "ar" and insert --are--.

Column 3, line 12, delete "acid", first occurrence, and insert --aid--.

Column 3, line 12, insert a --(-- before the word "stearic".

Column 4, line 43, delete "4,110,434" and insert --4,310,434--.

Column 4, line 57, delete "pyridnium" and insert --pyridinium--.

Column 5, line 38, delete "he" and insert --the--.

Claim 8, column 8, line 6, insert --6-- after "about" and before "%".

Signed and Sealed this

Fourth Day of June, 1991

*Attest:*

*Attesting Officer*

HARRY F. MANBECK, JR.

*Commissioner of Patents and Trademarks*